United States Patent [19]

Delaunay et al.

[11] Patent Number: 4,638,216

[45] Date of Patent: Jan. 20, 1987

[54] ELECTRON CYCLOTRON RESONANCE ION SOURCE

[75] Inventors: Marc Delaunay; René Gualandris; Richard Geller, all of Grenoble; Claude Jacquot, St Egreve; Paul Ludwig, Grenoble; Jean-Marc Mathonnet, Grenoble; Jean-Claude Rocco, Claix; Pierre Sermet, Grenoble; Francois Zadworny, Corenc; Francois Bourg, St. Martin d'Héres, all of France

[73] Assignee: Commissariat a l'Energie Atomique, Paris, France

[21] Appl. No.: 611,625

[22] Filed: May 18, 1984

[30] Foreign Application Priority Data

May 20, 1983 [FR] France ..... 83 08401

[51] Int. Cl.[4] ..... H01J 7/24; H05B 31/26

[52] U.S. Cl. ..... 315/111.81; 250/427; 313/359.1; 315/39; 315/111.91

[58] Field of Search ..... 315/39, 111.81, 111.91; 313/361.1, 359.1, 363.1; 250/427

[56] References Cited

U.S. PATENT DOCUMENTS

| | | | |
|---|---|---|---|
| 3,418,206 | 12/1968 | Hall et al. | 315/39 |
| 3,431,461 | 3/1969 | Dodo et al. | 315/39 |
| 3,778,656 | 12/1973 | Fremiot et al. | 315/111.81 |
| 4,045,677 | 8/1977 | Humphries, Jr. | 315/111.81 |
| 4,393,333 | 7/1983 | Sakudo et al. | 315/111.81 |
| 4,409,520 | 10/1983 | Koike et al. | 315/39 |
| 4,417,178 | 11/1983 | Geller et al. | 315/111.81 |
| 4,438,368 | 3/1984 | Abe et al. | 315/39 |

OTHER PUBLICATIONS

"Nuclear Instruments and Methods", vol. 196, May 1982, Amsterdam (NL), pp. 325–329.

"Nuclear Instruments and Methods", vol. 127, Aug. 1975, Amsterdam (NL), pp. 441–443.

"Japanese Journal of Applied Physics", vol. 11, No. 5, May 1972, Tokyo pp. 726–731.

*Primary Examiner*—Saxfield Chatmon

[57] ABSTRACT

An electron cyclotron resonance ion source in which a plasma is confined in a magnetic configuration having a first group of coils located in the plane defined by the tight window of an ultra-high frequency injector and surrounding the latter, supplying the magnetic field creating and confining a plasma as well as a second group of coils supplied in counter-field compared with the first group and surrounding an ion extraction system. Ion extraction takes place in a magnetic field well below that corresponding to the cyclotron resonance. This ion source has numerous applications in the field of thin layer sputtering, microetching, ion implantation, accelerators, etc.

10 Claims, 4 Drawing Figures

ELECTRON CYCLOTRON RESONANCE ION SOURCE

BACKGROUND OF THE INVENTION

The present invention relates to an electron cyclotron resonance ion source. It has numerous applications, as a function of the different values of the kinetic energy range of the extracted ions and can be used in thin layer sputtering, microetching, ion implantation, heating by fast neutrons the plasma of fusion reactors, tandem accelerators, synchrocyclotrons, etc.

In electron cyclotron resonance ion sources, the ions are formed by strongly ionizing a gas or a vapour of a solid contained in an ultra-high frequency cavity, as a result of the combined action of a high frequency electromagnetic field established in the cavity and a resultant magnetic field prevailing in said cavity. The magnetic field also has an amplitude $B_r$ satisfying the electron cyclotron resonance condition $B_r = f \cdot 2\pi(m/e)$ in which m is the mass of the electrons, e its charge and f the frequency of the electromagnetic field. This resonance makes it possible to strongly accelerate the electrons formed which, by impact on the neutral atoms of the gas or vapour, make it possible to strongly ionize the latter.

The operation of a cyclotron resonance source has more particularly been described in U.S. Pat. No. 4,417,178 filed in the name of the Applicant.

Hitherto, the constructions of electron cyclotron resonance ion sources, such as for example that described by R. Geller, C. Jacquot and P. Sermet in the "Proceedings of the Symposium on ion sources and formation of ion beams", Berckeley (October 1974) and F. Bourg, R. Geller, B. Jacquot, T. Lamy, M. Pontonnier and J. C. Rocco in "Nuclear Instruments and Methods", North-Holland Publishing Company 196, 1982, pp. 325–329 are based on the establishment of a confinement of the plasma with the aid of a magnetic mirror configuration. In the construction according to the first reference, the magnetic mirror configuration is obtained by means of three groups of coils.

FIG. 1 is a graph showing the curve of the magnetic field as a function of the distance along the central axis of the ion source according to the prior art by superimposing with a diagrammatic representation of the location of the main elements constituting this source. As shown in FIG. 1, the curve of the magnetic field 1 supplied by the coils has two maxima at the locations of the first group 2 and of the third group 4 of coils and a minimum between these two maxima at the location of the second group 3 of the coils, said latter group having a counter-field supply.

The maximum values are higher than the magnetic induction value $B_r$ corresponding to cyclotron resonance, resonance being reached between the two maxima. Thus, the plasma is created and confined in the area of the ion source located between said magnetic field maxima. The maximum and minimum values of the magnetic induction of said ion source are in this case 4200 and 3200 Gauss respectively. Electron cyclotron resonance takes place at 3600 Gauss, the frequency of the injected high frequency wave being fixed at approximately 10 GHz.

The ions created in the plasma are finally extracted by an extraction system 5, constituted by electrodes, which are located downstream of the second maximum of the magnetic field. Moreover, if as in the example described hereinbefore, the ion extraction system is positioned downstream of the second magnetic field maximum and if the latter is reduced, the ion current emitted by the source is reduced proportionately.

To obtain an intense ion current, the ions are consequently extracted in a magnetic field of the same order of magnitude as the cyclotron resonance field. If the ion beam is emitted in the magnetic field produced by the group of coils and if the magnetic field is suddenly eliminated downstream of the second coil of the ion source, the ions take up transverse energy and the ion beam diverges, i.e. its optical qualities are destroyed. This effect is described in the Bush theorum.

In order to retain the optical qualities of the beam downstream of the ion source, it is then necessary to keep the magnetic field constant in all the sliding space of the ion beam up to the location of its application or the transformation of the ions into neutral particles. For the example described hereinbefore, the field to be kept constant corresponds to an induction of approximately 3600 Gauss, whilst the electrical energy consumed by the coils 6 creating said magnetic field is approximately 1 megawatt.

In the case of the use of low energy ions (below 1 keV), the extraction system does not make it possible to extract the high densities. In order to increase the latter, it is possible to compress the ion beam downstream of the ion source. The magnetic field must be increased proportionately in order to compress the ion beam. Thus, the increase of the ion current density is limited by technical problems which occur with respect to the production of magnetic fields of this order of magnitude.

In summarizing, the prior art ion sources suffer from the disadvantages of a very high energy consumption of the magnetic configuration whilst the increase in the density of the low kinetic energy ion current is problemmatical due to the need for a high magnetic field.

SUMMARY OF THE INVENTION

The object of the present invention is to obviate these disadvantages. To this end, it provides a modification of the magnetic confinement configuration of the plasma in an electron cyclotron resonance ion source, which permits the extraction of the ions in a magnetic field well below that of the prior art ion sources.

The present invention specifically relates to an electron cyclotron resonance ion source incorporating a system for injecting an ultra-high frequency power into a container containing a gas or a vapour of a material for forming a plasma, the latter being created and confined in a magnetic configuration, and an ion extraction system, wherein the magnetic configuration is constituted by two groups of coils, the first group, located in the plane defined by the tight window of the ultra-high frequency injector and surrounding the latter, supplying the magnetic field confining the plasma, whilst the second group, supplied in counter-field with respect to the first group, surrounds the ion extraction system.

According to a preferred embodiment of the ion source, a third group of coils, installed downstream of the ion extraction system and supplied in the same direction as the first group, supplies a magnetic field higher than that of the extraction system in order to compress the extracted ion beam.

According to another feature, the magnetic field supplied by all the groups of coils has a maximum value which is higher than that of the cyclotron resonance at the location of the first group of coils, and the magnetic field decreases to a minimum value at the location of the second group of coils, whilst passing through the value of the magnetic induction $B_r$ corresponding to the cyclotron resonance between these two groups of coils.

According to another embodiment of an ion source, the position of the extraction system in the source is chosen in such a way that the low magnetic field at the extraction location is solely supplied by the first group of coils.

According to yet another embodiment of an ion source, the ultra-high frequency injection system is constituted by several ultra-high frequency injectors and each of these injectors is surrounded by a group of coils, the latter being located in planes defined by the tight windows of each injector.

According to another feature, the magnetic configuration of the confinement of the plasma also comprises a multipolar magnetic configuration constituted by permanent magnets.

According to another feature, the magnetic field corresponding to the cyclotron resonance is reached at a distance of approximately a few centimetres downstream of the jucntion between the ultra-high frequency injector and the cavity of the ion source.

According to another feature, gas injection takes place upstream of the ion extraction system and in the vicinity thereof.

According to another feature, the ion extraction system is constituted by a single electrode.

According to another embodiment of the ion source according to the invention, the gas for forming a plasma is deuterium and the minimum magnetic field at the location of the second group of coils is a few hundred Gauss.

BRIEF DESCRIPTION OF THE DRAWINGS

The invention is described in greater detail hereinafter relative to non-limitative embodiments and with reference to the attached drawings, wherein show.

DETAILED DESCRIPTION OF THE INVENTION

Figure 2A:
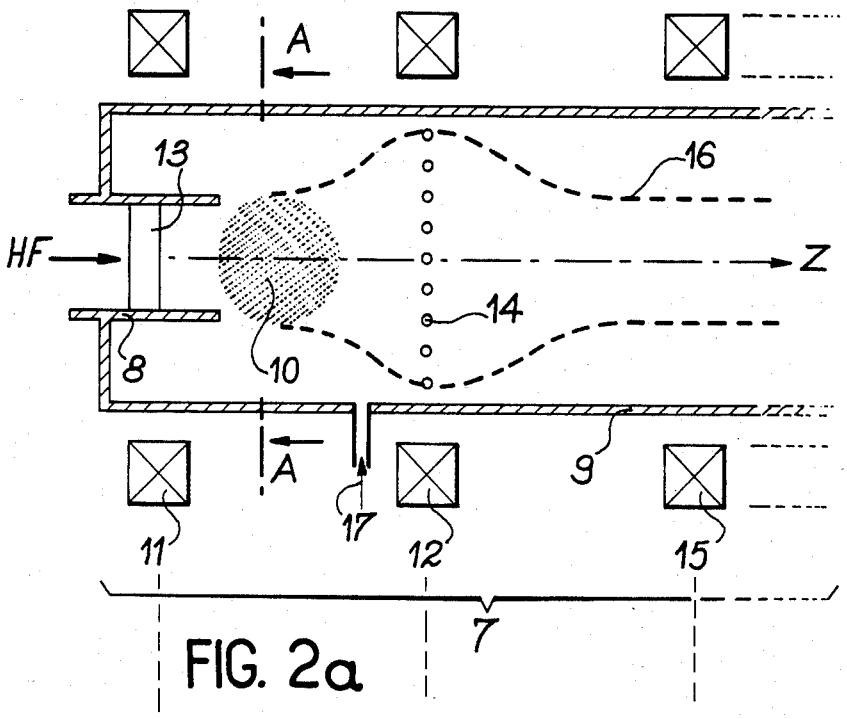
FIG. 2 a diagrammatically, an electron cyclotron resonance ion source according to the invention in section in the plane incorporating the central axis of the source.
FIG. 2*b* a graph showing the profile of the magnetic field as a function of the distance along the central axis of an ion source according to the invention.

FIG. 2*a* diagrammatically shows in simplified form an embodiment of an electron cyclotron resonance ion source in cross-section along the central axis of the source. In a vacuum cavity 9, e.g. in the form of a cylinder of revolution, one of the ends carries an ultra-high frequency power injector 8 and the other end is connected to the ion utilization location. It should be noted that cavity 9 can have a random shape, as a function of the character of the ion source. in particular, the ultra-high frequency power injection system 8 can be constituted by several ultra-high frequency injectors. At 17, a gas or a vapour is introduced, which is to serve to form a plasma under a low pressure of a few $10^{-3}$ Torr upstream of the ion extraction system and in the vicinity thereof.

An axial, static magnetic field is applied by means of coils surrounding the cavity. It is also possible to use permanent magnets surrounding the cavity for supplying the magnetic confinement field.

If the pulsation of the ultra-high frequency field $\omega$ is equal to the pulsation of the electron cyclotron resonance in the magnetic field, the plasma is produced.

In another embodiment of an ion source, the plasma is produced at another location and is then injected into cavity 9. The plasma is confined in the magnetic configuration obtained by means of two groups of coils 11, 12. The first group of coils 11 is located in the plane defined by the tight window 13 of the ultra-high frequency injector 8 and surrounds the latter. The second group of coils 12 is placed at a predetermined distance downstream of the first group of coils and is supplied in counter-field compared with the first group.

Figure 2B:
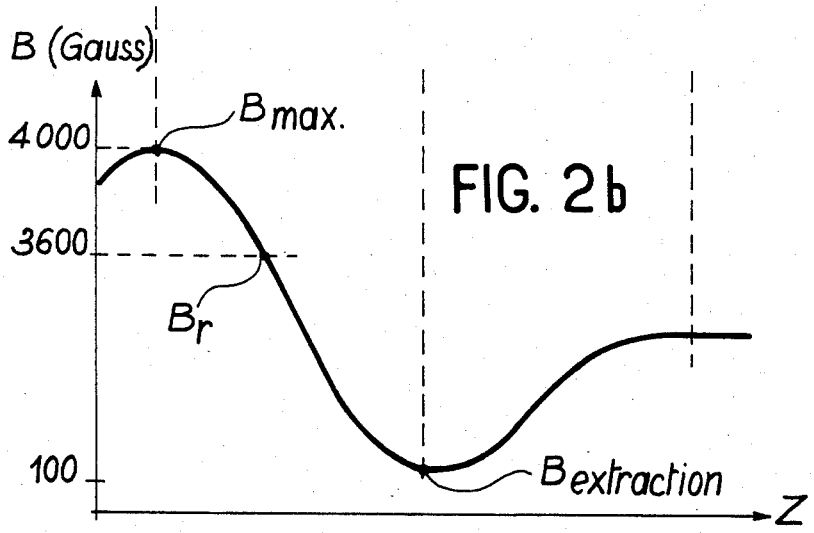

As is shown in FIG. 2*b*, the total of these two groups of coils supplies a magnetic field having a maximum value at the location of the first group of coils 11. This value exceeds the value $B_r$ corresponding to the electron cyclotron resonance. The magnetic field decreases to a minimum value at the location of the second group of coils 12.

In passing, the magnetic field reaches the value of the magnetic field $B_r$ corresponding to cyclotron resonance. It is also possible to choose the distance between the first group of coils and the extraction system in such a way that the magnetic field at the extraction location is solely supplied by the first group of coils.

The magnetic field profile is chosen in such a way that electron cyclotron resonance takes place a few centimetres downstream of the junction between the ultra-high frequency power injector and the cavity. Moreover, the resonance area is sufficiently remote from window 13 to ensure that the plasma 10 produced at this point hardly diffuses towards the latter and consequently there is no risk of it damaging the latter. Moreover, the resonance is sufficiently remote from the walls of the cavity to ensure that there is no reduction in the plasma density.

The number of coils forming a group depends on the magnetic field to be supplied. In a preferred realisation ofthe plasma magnetic confinement, between the first 11 and second 12 groups of coils is provided a multipolar magnetic configuration.

Figure 3:
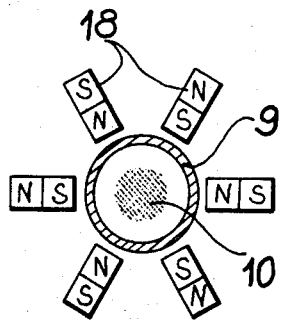
FIG. 3 diagrammatically and in cross-sectional form along the arrows fo FIG. 2, the hexapolar configuration of the supplementary magnetic confinement of the plasma.

FIG. 3 diagrammatically shows in cross-section along A—A of FIG. 2*a*, a hexapolar configuration of the supplementary magnetic confinement. Plasma 10 is confined by the lines of force of the magnetic field created by permanent magnet 18 distributed in ring-like manner around the cylindrical part of the cavity surrounding the plasma and whose polarities alternate.

In the case where the gas for forming plasma is deuterium, the frequency of the pulsation of the ultra-high frequency field is approximately 10 GHz, so that the electron cyclotron resonance is produced for an induction $B_r = 3600$ Gauss.

The maximum value of the induction $B_{max}$ at the location of the first group of coils is preferably chosen approximately 5000 Gauss and the value at the location of the second group of coils is preferably chosen as a few hundred Gauss. The ion extraction system 14 is located within the coils forming the second group.

It should be noted that in the source according to the invention, this magnetic induction value at the location of the extraction system is less than 10% of the value of the induction $B_r$ corresponding to cyclotron resonance. The extraction system can be in the form of a single electrode.

Figure 1:
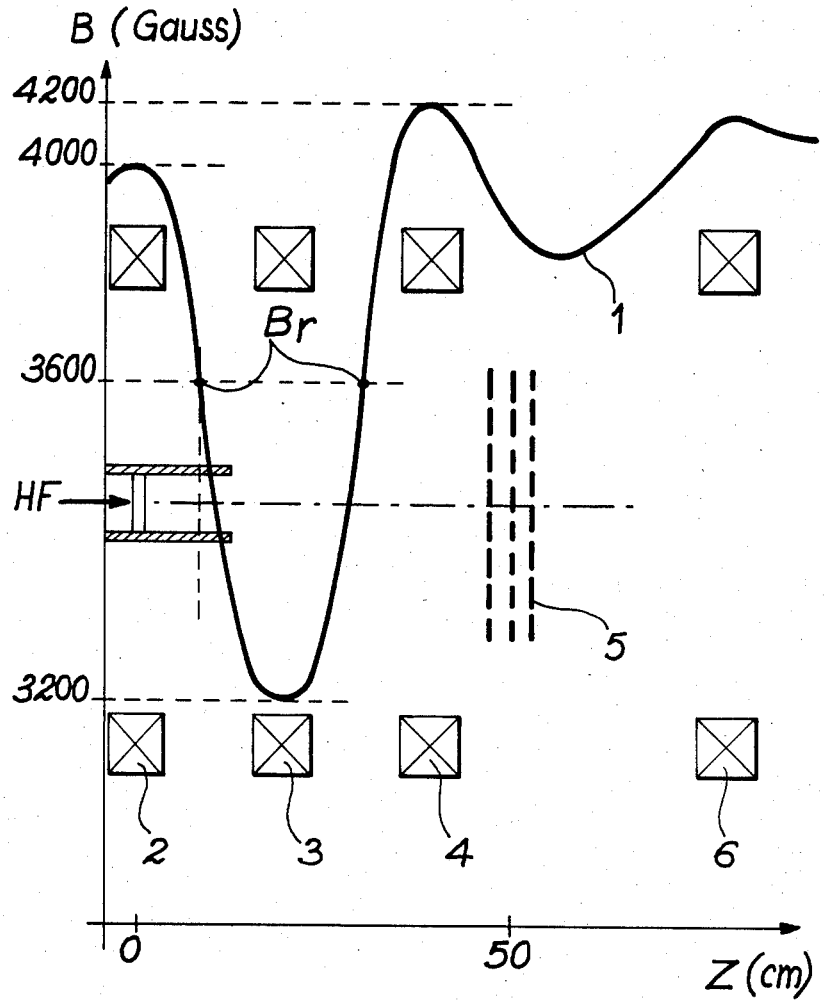
FIG. 1, already described, a graph showing the magnetic field curve as a function of the distance along the central axis of the prior art ion source with the superimposition of a diagrammatic representation of the location of several of the main elements constituting said source.

Tests carried out with an ion source according to the invention and with a positioning of the extraction system 14 have revealed that, unlike in the case of the tests carried out with ion sources according to the prior art, where the ion extraction system 5 (FIG. 1) is located downstream of a second maximum of the magnetic field of a plasma confinement, the current of ions extracted is not proportional to the magnetic induction value at the extraction location. Under comparable conditions, the ion current emitted by the ion source according to the invention is double that of a conventional source.

On increasing the ultra-high frequency power per volume unit, the ion current increases. It is then possible to extract higher ion currents, or reduce the width and diameter of the cavities, which leads to the use of "mini cavities", provided that the cyclotron resonance is in the cavity at a few centimetres from the guide—cavity transition.

It has also been found that the radial homogeneity of the extracted beam 16 is significantly improved and that the stability of the plasma 10 created in this magnetic configuration according to the invention is greater than that of the prior art.

The beam extracted from the ion source can be compressed, downstream of the extraction electrodes, by applying a magnetic field higher than that applied to the extraction system 14. The density of the ion current increases proportionately to the magnetic field applied.

This magnetic field is produced by means of a third group of coils 15, as shown in FIG. 2. The magnetic field at the ion extraction location is very low in order to retain or increase the optical quality of the ion beam upstream of the ion source, it then being merely necessary to provide coils for supplying a magnetic field well below that used in the prior art sources.

For the examples given hereinbefore, the energy consumption of these coils is reduced by a factor exceeding 10, so that there is a considerable energy saving.

According to another aspect relating to the optical quality of the ion beam, it is even possible to eliminate the magnetic field well before the location of its application and without any deterioration to its optical quality. The effect described in the Bush theorum becomes negligible, because the magnetic field is relatively weak. This leads to a further significant energy saving downstream of the ion source and the overall dimensions are reduced through the elimination of numerous coils.

What is claimed is:

1. A multimode electron cyclotron resonance ion source comprising: a system for injecting an ultra-high frequency power into a container containing a gas or a vapor of a material for forming a plasma, said system having a tight window in a plane, a magnetic configuration in which said plasma is created and confined, and an ion extraction system, said magnetic configuration comprising: at least one group of coils supplying a magnetic field having a maximum value which is higher than that of the electron cyclotron resonance, in the plane defined by the tight window, and said magnetic field decreasing to a minimum value in front of the ion extraction system, while passing through the value of the magnetic induction $B_r$ corresponding to the cyclotron resonance, the value of said magnetic field continually decreasing from said window to said ion extraction system.

2. A source according to claim 1, wherein the magnetic configuration comprises a first and a second group of coils, said first group being located in the plane defined by the tight window and surrounding said injecting system, said second group, supplied in counter-field with respect to said first group, surrounding said ion extraction system.

3. An ion source according to claim 2, comprising a third group of coils installed downstream of the ion extraction system and supplied in the same direction as said first group and supplying a magnetic field higher than that of the extraction system in order to compress the extracted ion beam.

4. An ion source according to claim 1, wherein the magnetic configuration is constituted by only one group of coils located in the plane defined by the tight window of the ultra-high frequency injecting system and surrounding said injecting system.

5. An ion source according to claim 1, wherein the ultra-high frequency injection system is constituted by several ultra-high frequency injectors, each of said injectors being surrounded by a group of coils, said group being located in planes defined by the tight windows of said injectors.

6. An ion source according to claim 1, wherein the magnetic configuration also comprises a multipolar configuration constituted by permanent magnets.

7. An ion source according to claim 1, wherein the magnetic field corresponding to cyclotron resonance is reached at a distance of approximately a few centimeters downstream of the junction of the ultra-high frequency injection system with a cavity of the ion source.

8. An ion source according to claim 1, wherein the injection of the gas takes place upstream of the ion extraction system and in the vicinity thereof.

9. An ion source according to claim 1, wherein the ion extraction system is constituted by a single electrode.

10. An ion source according to claim 2, wherein the gas for forming the plasma is deuterium and wherein the magnetic field at the location of the second group of coils is a few hundred Gauss.

* * * * *